United States Patent [19]

Jones

[11] Patent Number: 4,965,023

[45] Date of Patent: Oct. 23, 1990

[54] CARBURETOR HAVING BIDIRECTIONAL FUEL PASSAGE

[75] Inventor: James S. Jones, Richardson, Tex.

[73] Assignee: David Ward

[21] Appl. No.: 339,250

[22] Filed: Apr. 7, 1989

[51] Int. Cl.[5] ..... F02M 7/20

[52] U.S. Cl. ..... 261/34.2; 261/69.2; 261/39.2; 261/39.3

[58] Field of Search ..... 261/69.2, 39.2, 39.3, 261/34.2

[56] References Cited

U.S. PATENT DOCUMENTS

| | | | |
|---|---|---|---|
| 1,857,889 | 5/1932 | Sturm | 261/41 |
| 2,173,281 | 9/1939 | Lichtenstein | 261/69.2 |
| 2,316,327 | 4/1943 | Garretson | 261/69 |
| 2,372,306 | 3/1945 | Adair | 261/69 |
| 2,457,171 | 12/1948 | Mock | 261/39.2 |
| 2,486,223 | 10/1949 | Stresen-Reuter | 261/39.2 |
| 2,507,075 | 5/1950 | Wiegand et al. | 261/69 |
| 2,551,719 | 5/1951 | Ball | 261/34.2 |
| 2,580,294 | 12/1951 | Griffon | 261/69.1 |
| 2,584,911 | 2/1952 | Orr, Jr. | 261/69.2 |
| 2,635,862 | 4/1953 | Stoltman | 261/41 |
| 2,674,443 | 4/1954 | Bracke | 261/41 |
| 2,680,605 | 6/1954 | Bracke | 261/69 |
| 2,694,560 | 11/1954 | Olson | 261/41 |
| 2,852,240 | 9/1958 | Goodyear | 261/41 |
| 2,986,380 | 5/1961 | Read | 261/39.5 |
| 3,009,794 | 11/1961 | Barfod | 261/69 |
| 3,067,020 | 12/1962 | Holzapfel | 261/69 |
| 3,109,874 | 11/1963 | Mennesson | 261/39.2 |
| 3,201,097 | 8/1965 | Arndt | 261/41 |
| 3,246,886 | 4/1966 | Goodyear et al. | 261/39.5 |
| 3,409,276 | 11/1968 | Fuchs | 261/69 |
| 3,587,553 | 6/1971 | Sutton | 261/39.5 |
| 3,779,529 | 12/1973 | Kimura | 261/69 |
| 4,329,964 | 5/1982 | Morris | 261/41 |
| 4,387,063 | 6/1983 | Pontoppidan | 261/41 |
| 4,632,788 | 12/1986 | Jones | 261/41.5 |

*Primary Examiner*—Tim Miles

[57] ABSTRACT

An improved bidirectional fuel passage carburetor includes an air density compensator and overall trim, an increased idle air and enrichment device, an air bounce check valve, a fuel valve shutoff, and a load enrichment device. In an alternate embodiment, the carburetor includes a load trim screw for adjustment the main fuel orifice. In yet another embodiment of the invention, temperature compensation for the air-fuel ratio is provided.

6 Claims, 2 Drawing Sheets

CARBURETOR HAVING BIDIRECTIONAL FUEL PASSAGE

Technical Field

This invention relates to air-fuel systems for internal combustion engines and more specifically to systems where the fuel is liquid a ambient conditions.

Background of the Invention

The carburetor of the present invention represents a substantial improvement over the bidirectional fuel passage carburetor disclosed in my U.S. Pat. No. 4,632,788, issued Dec. 30, 1986, the disclosure of which is incorporated by reference as if fully set forth herein.

High speed hard surface vehicles that operate over broad ambient conditions, such as automobiles, would benefit greatly if altitude compensation were included in my bidirectional fuel passage carburetor. Systems that operate predominantly at the same altitude like fork lifts, construction equipment, stationary generators, and the like would produce very little gain with air density compensation, however.

In high performance vehicles without governors that are started with closed throttles, my bidirectional fuel passage carburetor would benefit from a system that reads ambient temperature and bypasses the throttle with additional air and enriches the total air charge for starting and warmup.

It has been found that engines having one, two or three cylinders experience an "air bounce" in the induction system when the engine is idling and the throttle is suddenly opened. This bounce is a pressure wave which can move the air diaphragm in bidirectional fuel passage carburetor away from the disc causing a momentary weak fuel charge. The bidirectional fuel passage carburetor would be greatly improved for use with such engines if air bounce were eliminated.

Operations such as arc welders operating at governed speed, no load, at lean air fuel ratios with instant maximum load demand, require fuel instantly. Some means for rapidly supplying a fuel enrichment upon maximum load is highly desirable.

Substantially all applications for my bidirectional fuel passage carburetor require a system to close the fuel system when there is no demand. The ideal solution would be to return the fuel valve to its seat without adversely effecting the intended operation.

It can thus be seen that there presently exists a need for an improved bidirectional fuel passage carburetor which eliminates the drawbacks discussed above.

Brief Description of the Drawings

A more complete understanding of the invention and its advantages will be apparent from the Detailed Description taken in conjunction with the accompanying Drawings, in which.

Detailed Description

Figure 1:
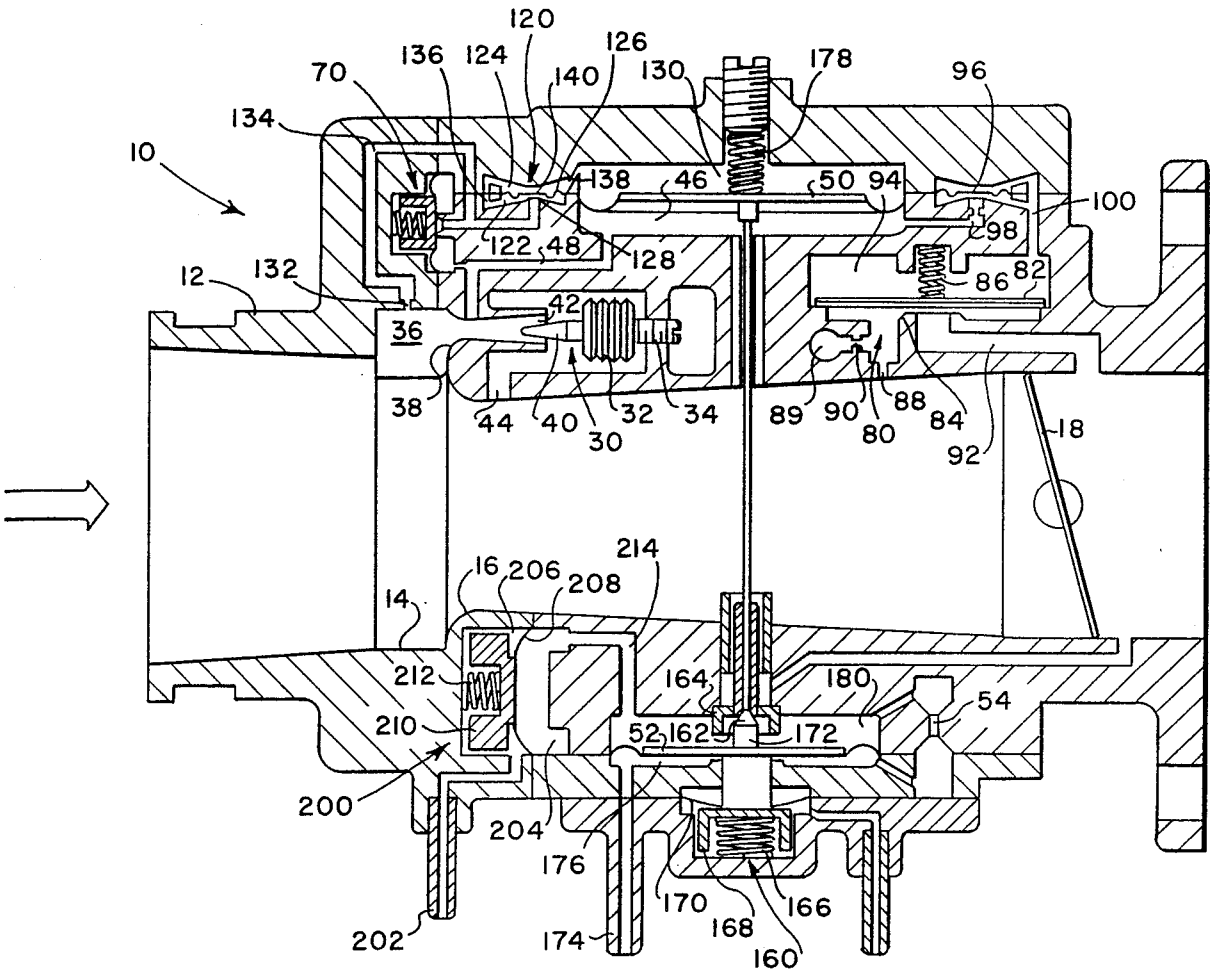
FIG. 1 is a partially broken-away side view of a carburetor incorporating some of the improvements of the present invention.

Referring initially to FIG. 1, a bidirectional fuel passage carburetor 10 includes a body 12 having an air inlet 14, a main venturi 16, and a throttle butterfly 18.

The air density compensator and overall trim 30 uses an expandable sealed bellows compartment 32 that is filled with a dry inert gas. Bellows compartment 32 is mounted on a threaded section 34 that serves as an overall air-fuel ratio trim. A small booster venturi 36 receives air from inlet 14 which is accelerated at the venturi throat 38 to 1.87 times the velocity at venturi 16 when the metering pin 40 is fully withdrawn, representing an air density of 0.097 lbs. per cubic foot, and to a velocity of 1.24 times the air velocity at venturi 16 with the pin 40 in its fully extended position representing an air density of 0.030 lbs. per cubic foot.

The air leaving the booster venturi 36 at the recovery exit 42 joins the main air stream at venturi 16 through a rather large opening 44 which exposes the bellows compartment 32 to the temperature and pressure of the air flowing through venturi 16. The vacuum signal of the booster venturi 36 is communicated to the air diaphragm vacuum chamber 46 by way of passage 48. The air diaphragm 50 has a greater area than the fuel diaphragm 52 and amplifies the fuel pressure across the fuel orifice 54. So the sizing of the fuel orifice 54 relates the size of venturi 16, the diaphragm ratios of fuel diaphragm 52 and air diaphragm 50, the booster venturi 38, ratio at maximum air density and a power air fuel ratio of 12.7. With the proper sizing of the fuel orifice 54 and the venturi 16, the overall adjusted trim at any air density will be proper over a range of encountered air densities. The part throttle control 70 is described in my prior U.S. Pat. No. 4,632,788 and is proportional to the air signal in chamber 46; therefore, its function is not effected by the overall compensation.

The increased idle air and enrichment device 80 has a bi-metal strip 82 that forms a valve with seat 84 that is closed by spring 86 at all normal operating temperatures. At temperatures lower than normal operating temperatures, the strip 82 bows away from seat 84 allowing the flow of air from the main air stream across air orifice 88 and exhaust gases from passage 89 connected to the exhaust manifold through orifice 90 through passage 92 into the main air stream between the throttle butterfly 18 and the engine. The air supplied through passage 92 will increase the engine idle speed. When the movement of air through passages 88 and 89 is great enough to provide a vacuum in chamber 94 that is greater than the vacuum in chamber 46, check valve 96 will open to allow an air flow from the booster venturi 38 through passage 48 into chamber 46 across orifice 98 into chamber 94 by way of passage 100. This flow of air increases the air signal in chamber 46 which enriches the fuel mixture. This increase is an addition to the normal mixture and diminishes rather quickly with increase of air across the throttle plate 18. The exhaust gases through passage 89 and orifice 90 provides means to heat strip 82 to provide a rather quick shut down of the increased idle air and enrichment device 80.

Air bounce check valve 120 has an entry chamber 122 and an exit chamber 124. Chambers 122 and 124 are separated by a portion of diaphragm 126. The entry point to chamber 122 is valve seat 128 in the center of entry chamber 122. Free movement of air into chamber 130 by way of orifice 132 at air inlet 11 and passage 134 into entry chamber 122 is allowed by way of seat 128.

Air then flows into exit chamber 124 by way of passage 136 and on into chamber 130 by way of passage 138. Air flow out of entry chamber 12 forces diaphragm 126 on to seat 128, greatly restricting the backflow, and thereby restricting the movement of diaphragm 126 away from its disc 140 with an air bounce pressure rise in chamber 20.

Fuel shut off device 160 is intended to be used with fuel pumps that do not store a quantity of fuel under pressure when shut down. With the engine at rest, the throttling valve 162 is held against its seat 164 by the load of spring 166 acting against piston 168, diaphragm 170 and pin 172. When the fuel pump is started, fuel is fed through inlet 174 into the unmetered fuel chamber 176 where its pressure acts across diaphragm 170 to overcome spring 166, allowing idle trim spring 178 to unseat valve 162. Fuel from chamber 176 enters the metered fuel chamber 180 through main fuel orifice 54, ready to be throttled by valve 162 upon engine demand.

Load enrichment device 200 is on the metered fuel side of the fuel orifice 54 and is a spring actuated diaphragm pump that is charged with fuel by manifold vacuum through port 202 connected to the intake manifold. The pump has a fuel chamber 204 and a vacuum chamber 206, with these chambers separated by a diaphragm 208 with a piston 310 that is loaded with a spring 212. With the engine at an idle mode, either slow speed or high speed, the device 208 is fully charged through passage 214. When the load is increased suddenly, the pump preferably will start to discharge at about 14" Hg. manifold vacuum. The air diaphragm 50 will read the increased demand and will open the fuel valve 162 in an effort to maintain the normal fuel demand across the main fuel orifice 54; however, the initial device 200 pressure is greater than the fuel pump pressure allowing the rapid discharge of the device into chamber 54 by way of passage 214. Preferably the device 200 will not fully recharge until the engine load is reduced to less than 25% load.

Figure 2:
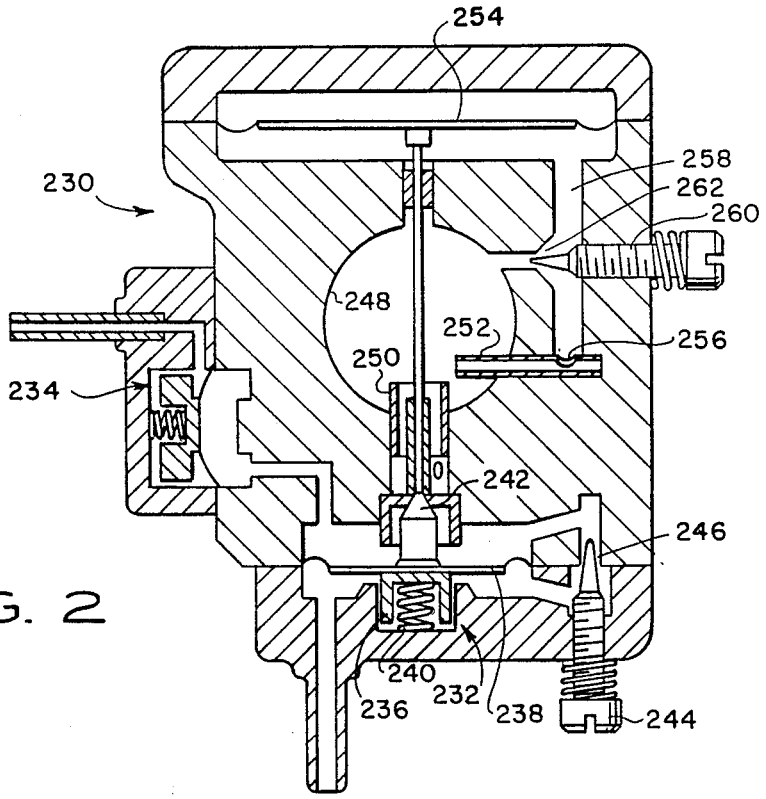
FIG. 2 is a partially broken-away end view of a first alternate embodiment of a carburetor including some of the improvements of the present invention.

Referring now to FIG. 2, an alternate embodiment of my bidirectional fuel passage carburetor 230 is preferably used on systems started with a conventional butterfly choke, equipped with a conventional standard engine- driven diaphragm fuel pump, and not requiring low speed maximum load operation, such as systems used to power generators, water pumps, welders, systems with torque converters, and the like. Fuel shut off device 232 and load enrichment device 234 are as previously described with respect to FIG. 1. Shut off piston 236 is always in contact with fuel diaphragm 238 by force of spring 240, closing fuel throttling valve 242 when there is no fuel demand. The load trim screw 244 adjusts the main fuel orifice 246 for the overall desired air-fuel ratio. The air intake to the bidirectional fuel passage is in the venturi 248 at the end of tube 250, which provides a source of vacuum at all light loads due to high air velocities. Vacuum pickup tube 252 is positioned to receive the vacuum to act on air diaphragm 254 to unseat the throttling valve 242 and overcome spring 240 to allow the fuel to flow. This vacuum acting across orifice 256 in tube 252 is properly reduced by bringing air into passage 258 from venturi 248 across idle trim screw 260 and bleed orifice 262. Vacuum pickup tube 252 and bleed orifice 262 are both in the throat of the venturi, therefore there is no adverse effect on the system.

Figure 3:
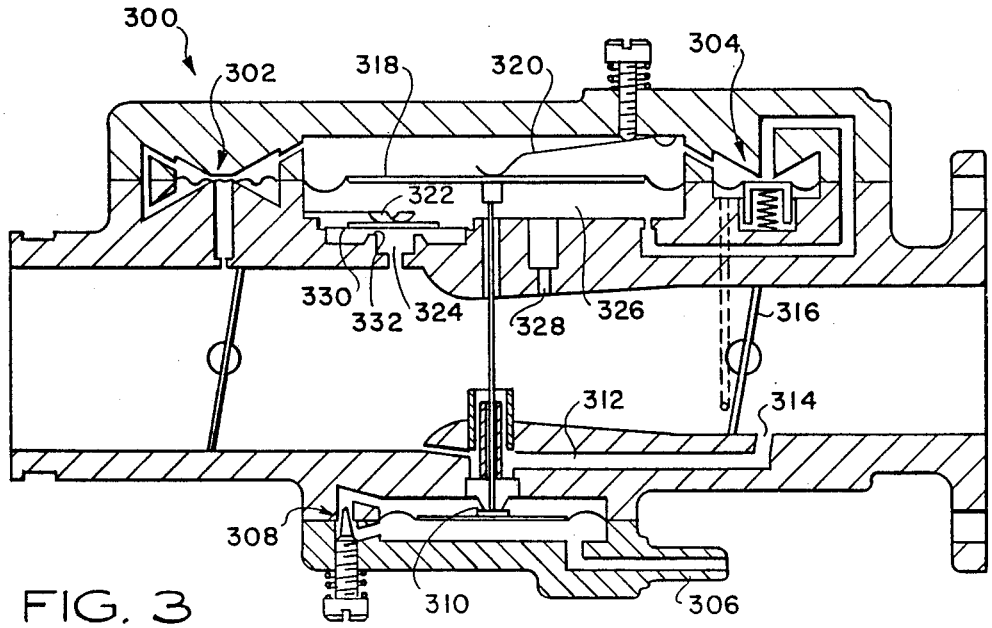
FIG. 3 is a partially broken-away side view of a second alternate embodiment of a carburetor incorporating some of the improvements of the present invention.

Referring now to FIG. 3, another alternate embodiment of my bidirectional fuel passage carburetor 300 provides temperature compensation for the air-fuel mixture. Carburetor includes air bounce check valve 302 and part throttle control 304 as previously described. Fuel inlet 306 is metered across orifice 308 and fuel control valve 310, as previously described. Bidirectional fuel passage 312 extends between fuel valve 310 and discharge 314 downstream of throttle valve 316. Air diaphragm 318 is biased by way of leaf spring 320 against the pressure differential across orifice 308. Temperature compensation is provided by way of bi-metal element 322 across air signal passage 324. Air signal passage 324 admits air into air reader chamber 326, which signal is adjusted with changes in temperature to control the flow of air out of chamber 326 through control orifice 328 located in the venturi throat. More air is admitted through passage 324 under hot conditions. Flow is controlled by diaphragm 330 being positioned with respect to seat 332 by way of bi-metal spring 322.

Whereas the present invention has been described with respect to specific embodiments thereof, it will be understood that various changes and modifications will be suggested to one skilled in the art and it is intended to encompass such changes and modifications a fall within the scope of the appended claims.

I claim:

1. A bidirectional fuel passage carburetor for an internal combustion engine, the carburetor being connected to a source of liquid fuel for establishing a fuel supply for the engine at an air-fuel ratio and being connected to the engine by an intake manifold, comprising:

means for compensating for changes in air density;

means for eliminating air bounce of an air diaphragm resulting from pressure pulses in said intake manifold;

means for rapidly enriching said fuel supply upon load increase;

warm up means responsive to below normal operating temperatures for increasing idle air flow and enriching said fuel supply;

means for shutting off said connection to said source of liquid fuel when said engine is shut off; and means for adjusting said air-fuel ratio in compensation for ambient air temperature changes.

2. A bidirectional fuel passage carburetor for an internal combustion engine, the carburetor being connected to a source of liquid fuel for establishing a fuel supply for the engine at an air-fuel ratio and being connected to the engine by an intake manifold, comprising:

warm up means including a bimetal strip for modulating a flow of air through a passage bypassing a main throttle in a main air flow through said carburetor;

said bimetal strip being responsive to engine temperature by way of exhaust gases routed past said bimetal strip; and said flow of air modulated by said bimetal strip being routed through said carburetor to enrich the fuel mixture.

3. A bidirectional fuel passage carburetor for an internal combustion engine, the carburetor being connected to a source of liquid fuel for establishing a fuel supply for the engine at an air-fuel ratio and being connected to the engine by an intake manifold, comprising:

means for compensating for changes in air density including an expandable bellows compartment responsive to air density;

wherein said bellows compartment is located adjacent a booster venturi in a main air stream through said carburetor and is expandable and retractable to vary the cross-sectional area of said booster venturi in response to changes in air density; and wherein a signal from said booster venturi is communicated to an air diaphragm vacuum chamber to adjust said air-fuel ratio of said carburetor.

4. The carburetor of claim 3 further comprising: means with said bellows compartment for manually adjusting said cross-sectional area of said booster venturi, such that an adjustment for overall air-fuel ratio is provided.

5. A bidirectional fuel passage carburetor for an internal combustion engine, the carburetor being connected to a source of liquid fuel for establishing a fuel supply for the engine at an air-fuel ratio and being connected to the engine by an intake manifold, comprising:

means for eliminating air bounce of an air diaphragm resulting from pressure pulses in said intake manifold.

6. The bidirectional fuel passage carburetor of claim 5 wherein said means for eliminating air bounce includes a check valve for restricting movement of air out of a chamber for said air diaphragm due to an air bounce but for allowing normal movements of air associated with said air diaphragm.

* * * * *